US006261043B1

(12) United States Patent
Weems et al.

(10) Patent No.: US 6,261,043 B1
(45) Date of Patent: Jul. 17, 2001

(54) MATERIAL MOVING SYSTEM

(75) Inventors: Casey A. Weems; Douglas K. Jaskari, both of Pickerington; Mark S. Shirley, New Albany, all of OH (US); Craig L. Peters, Western Springs, IL (US)

(73) Assignee: AMSTED Industries Incorporated, Chicago, IL (US)

( * ) Notice: Subject to any disclaimer, the term of this patent is extended or adjusted under 35 U.S.C. 154(b) by 0 days.

(21) Appl. No.: 09/464,818

(22) Filed: Dec. 17, 1999

(51) Int. Cl.[7] ..... B66C 11/12; B66C 1/06; B66C 1/34

(52) U.S. Cl. ..... 414/191; 414/160; 414/199; 294/68.22; 294/68.24; 335/294

(58) Field of Search ..... 335/294; 414/160, 414/191, 199; 294/68.22, 68.24

(56) References Cited

U.S. PATENT DOCUMENTS 3,529,733 * 9/1970 Walzel ..... 414/191
4,360,304 * 11/1982 Brewer et al. ..... 414/191
4,564,327 * 1/1986 Lunig ..... 414/199
5,748,062 * 5/1998 Kirkpatrick ..... 335/294

* cited by examiner

*Primary Examiner*—Steven A. Bratlie
(74) *Attorney, Agent, or Firm*—Edward J. Brosius

(57) ABSTRACT

A material moving system is disclosed for use in a plant such as a metal foundry. There is an overhead gantry for moving a main hook and auxiliary hook. The main hook carries a container such as a scrap charge bucket. The auxiliary hook carries a multi-function auxiliary tool such as a magnet with a tool hook affixed to the magnet. The scrap charge bucket carries a target member on a saddle on the outside of the bucket. The bucket also has a hold out stand that positions the target member for easy accessibility. The target member is attached to actuator cables that are attached to clam shell bottom members of the scrap charge bucket. The auxiliary tool may be used to lift and pull the target member to open the clam shell members without removing the magnet from the auxiliary hook, saving time. The hook on the magnet is positioned so that the hook does not damage the scrap metal bins or electric arc furnaces when the magnet is used for its usual purposes. The target member is shaped so that its position on the magnet is secure when it is lifted off of the saddle support; it has two plates with edges that complement the shape of the magnet, and with a center of gravity that tends to hold the target member against the magnet.

22 Claims, 7 Drawing Sheets

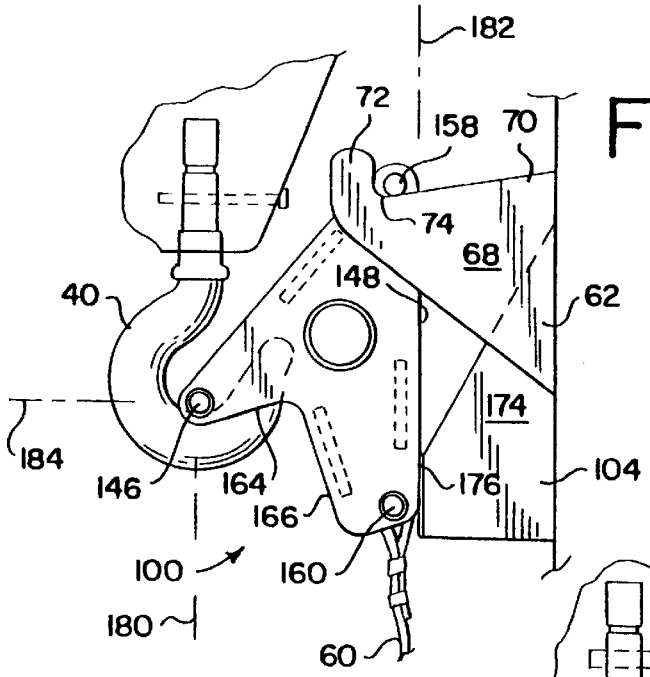
FIG. 19
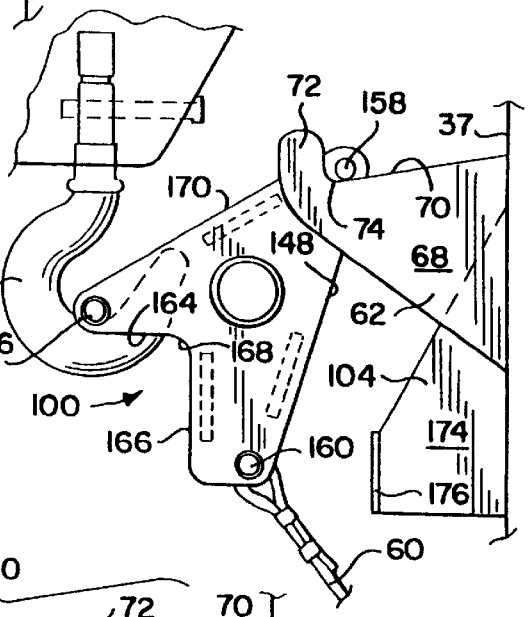
FIG. 20
FIG. 21
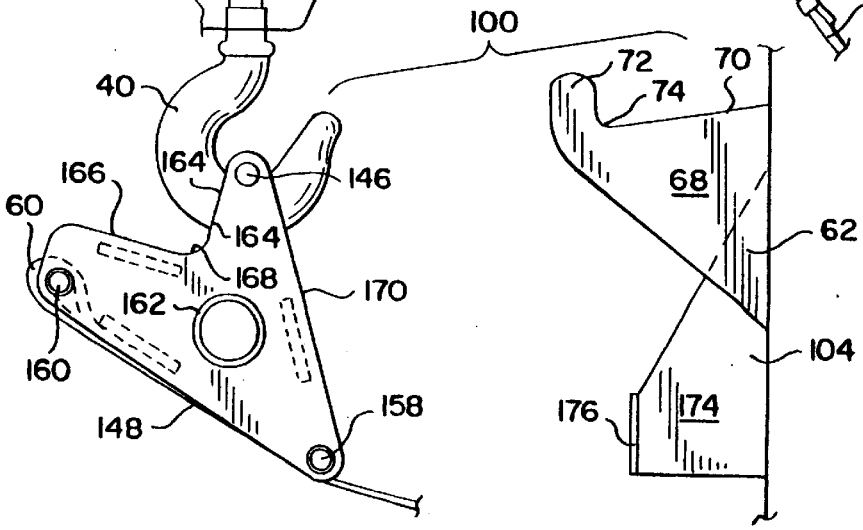

MATERIAL MOVING SYSTEM

BACKGROUND OF THE INVENTION

1. Field of the Invention

The present invention relates to systems for moving material from one location to another, and more particularly, to such systems used for moving scrap metal from a scrap metal bin to an electric arc furnace.

2. Description of the Prior Art

In typical manufacturing plants, such as in steel foundries, scrap metal is brought into the plant by rail or by truck, and the scrap metal is then typically placed in a storage device such as a storage bin. A schematic plan view of a part of a representative steel foundry is illustrated in FIG. 1, where a set of rail tracks is designated 10, and scrap metal bins are shown at 12–16. Downstream of the scrap metal bins 12–16 are located one or more furnaces, commonly electric arc furnaces, designated 20–24 in FIG. 1.

To move material from the bins 12–16 to the furnaces 20–24, systems for moving material from one location to another have been used. In the illustrated foundry, the material to be moved is scrap metal.

A representative material-moving system is illustrated in FIGS. 1–2, and is generally designated 26. The material-moving system 26 includes an overhead gantry 28 comprising a pair of spaced rails 30. A two-piece bridge 32 spans the rails 30, and includes wheels 34 at the ends of each piece of the bridge. The wheels travel along the rails 30 so that the bridge 32 may be moved along the gantry 28 in opposite directions. The two pieces of the bridge 32 are connected by a trolley 36. The trolley 36 is movable along the bridge 32 in opposite directions. The motion of the bridge 32 and the motion of the trolley 36 are both substantially horizontal. The motion of the trolley 36 on the bridge 32 is substantially at right angles to the motion of the bridge 32 on the gantry 28. Thus, the trolley 36 may be moved in both the X and Y directions through controlled movement of the bridge 32 and trolley 36.

The material-moving system 26 includes a container 37 for material to be moved, a vertically-movable main hook 38 and a vertically-movable auxiliary hook 40. The movements of the hooks 38, 40, bridge 32 and trolley 36 are controlled by an operator in a cab, typically positioned along the bridge 32, as shown at 39 in FIGS. 1–2. Thus, the operator is generally positioned above the factory floor 41. Both hooks 38, 40 are suspended from the trolley 36. Thus, the hooks 38, 40 move in unison with the trolley 36 in the X and Y directions, and move independently in the Z or vertical direction.

As shown in FIGS. 3–4, the container 37 for material to be moved has a hollow main body 42 with an exterior surface 44, an open interior 46 and top and bottom openings 48, 50 leading into the open interior 46 of the main body 42. There is at least one movable structure 54, 56 for covering and uncovering one of the openings 50 into the open interior 46 of the main body 42. There is at least one actuator 58, 60 connected to each movable structure 54, 56.

As shown in FIGS. 3–4, a two-piece saddle 62 extends outwardly from the exterior surface 44 of the main body 42 of the container 37. A target member or ring 64 is supported on the saddle 62 and connected to the actuator 58, 60 so that the opening 50 to the container 37 can be uncovered by pulling on the target member 64.

In the illustrated steel foundry, the container 37 comprises a scrap charge bucket for scrap metal. There are two movable structures 54, 56 for covering and uncovering the bottom opening 50 into the open interior 46 of the main body 42; these two movable structures 54, 56 are pivotable, and open in a general clam shell manner, as shown in FIG. 4. There are two actuator cables 58, 60: one actuator cable 58, 60 is attached to each pivotable clam shell structure 54, 56, and both actuator cables 58, 60 are attached to the target member 64. The target member 64 defines a ring that is supported on the saddle 62.

The saddle 62 comprises two saddle plates 66, 68 fixed to the exterior surface 44 of the scrap charge bucket main body 42. One saddle plate 68 is shown in FIG. 4A; each saddle plate 68 has a support surface 70 and an upstanding retention member 72 that meet in a nook 74. The target ring 64 straddles the two saddle plates 66, 68, and rests on the support surfaces 70 in the nooks 74. To open the pivotable clam shell structures 54, 56, the target ring 64 is lifted off the saddle 62 and pulled upwards, as shown in FIG. 4.

To carry the scrap charge bucket 37 and to open the pivotable clam shell structures 54, 56, the main and auxiliary hooks 38, 40 are used. Both the main and auxiliary hooks 38, 40 are suspended from the trolley 36, and both hooks 38, 40 are movable substantially vertically on the trolley 36. In one production stage in a steel foundry, the main hook 38 is used to pick up the empty scrap charge bucket 37, to move the empty scrap charge bucket near to the scrap bins 12–16 for filling with scrap metal, and to move the filled scrap charge bucket to one of the furnaces 20–24 for unloading the scrap metal into the furnace. At another stage of production, the main hook 38 is used to move an empty ladle to one of the electric arc furnaces for filling with molten metal, and to move the filled ladle. Depending on the type of production employed at the plant, the ladle may be moved to molds so that the molds may be filled with molten metal, or the ladle may be moved to another area of the plant for use in bottom pressure casting, for example.

In plants having only two hooks, the auxiliary hook 40 is used for different purposes at different times of production. Commonly, the auxiliary hook 40 is used to capture and lift the target ring 64 off of the saddle on the scrap charge bucket, pulling the target ring 64 until the pivotable clam shell bottom members 54, 56 are opened so that the scrap metal may be dropped into the furnace. The auxiliary hook 40 is also used to replace the target ring 64 on the saddle 62 of the scrap charge bucket 37. At other stages of production, the auxiliary hook 40 is used to lift and move a large electromagnet 76, shown at in FIG. 3, to move scrap metal from the rail car or scrap bins 12–16 or to load the scrap charge bucket 37 with scrap metal. This electromagnet 76 is sometimes also used inside the electric arc furnace 20–24 to remove excess scrap metal, to unload additional scrap into the furnace, or to level the scrap metal in the furnace. The auxiliary hook 40 may be used to carry tools other than a magnet, such as other general and special tools supplied by overhead crane suppliers, for example.

In plants with only one auxiliary hook 40, the performance of its various functions has required that the auxiliary hook 40 sometimes carry the magnet 76 and sometimes operate without the magnet 76. This leads to downtime as the magnet 76 is removed and replaced. In some other typical plants, three hooks are provided so that the magnet can remain on one of the hooks while the third hook is used to operate the mechanism that opens the scrap charge bucket 37. This solution saves time but adds to the cost and complexity of the systems at the plant.

In any event, use of the hooks requires some skill and visual acuity on the part of the crane operator, who must be able to see the target ring 64, for example, and be able to manipulate the hooks into their proper positions from the operator's position in the cab 39, typically at some distance from the hook.

SUMMARY OF THE INVENTION

The present invention is directed to improving the efficiency of plant operation without substantially increasing the cost or complexity of plant systems.

In one aspect, the present invention affords these advantages by providing a system for moving material from one location to another location that uses a multi-function auxiliary tool. The system comprises a container for material to be moved. The has a main body with an exterior surface, an open interior and at least one opening leading into the open interior of the main body. The container also includes at least one movable structure for covering and uncovering the opening into the open interior of the main body, and at least one actuator for moving the movable structure. The system further includes a vertically movable main hook and a vertically movable auxiliary hook. The main hook and auxiliary hook are movable in a plurality of horizontal directions. The container is suspended from the main hook. The auxiliary multi-function tool is suspended from the auxiliary hook. The auxiliary multi-function tool includes a primary tool and a secondary tool. The system also includes a target member connected to the actuator so that the opening to the container can be uncovered by moving the target member. The auxiliary tool is movable so that at least part of the secondary tool may engage at least a part of the target member so that the target member may be moved by moving the auxiliary multi-function tool and engaged target member.

In another aspect, the present invention affords these advantages by providing a system for moving material from one location to another location, the system including a container for material to be moved, a cable bracket and a hold out stand. The container has a bail and a main body. The main body has an exterior surface, an open interior and at least one opening leading into the open interior of the main body. The container also includes at least one movable structure for covering and uncovering the opening into the open interior of the main body, at least one actuator cable connected to move the movable structure, and a saddle member. The saddle member has an open end. The system includes a vertically movable main hook and a vertically movable auxiliary hook. The main hook and auxiliary hook are movable in a plurality of horizontal directions. The container is suspended from the main hook. There is a cable bracket supported on the saddle member. The cable bracket is connected to the actuator cable. The cable bracket includes a catch member so that the opening to the container can be uncovered by pulling on the catch member of the cable bracket. At least part of the catch member lies in a vertical plane spaced from the saddle member. The cable bracket further includes a substantially vertical hold out surface spaced from the vertical plane of the catch member. The system further includes a hold out stand on the container. At least part of the hold out stand bears against at least part of the hold out surface of the cable bracket. The horizontal distance between the vertical plane of the catch member and the container is greater than the horizontal distance between the container and the open end of the saddle member. The cable bracket is removable from the saddle member, and the orientation of the cable bracket hold out surface changes as the cable bracket is removed from the saddle member.

In another aspect, the present invention affords these advantages by providing a system for moving material from one location to another that utilizes a multi-function tool. The system comprises an overhead gantry, a bridge and a trolley. The bridge extends between portions of the gantry and is movable along the gantry in opposite directions. The trolley is movable along the bridge in opposite directions. The motion of the trolley on the bridge is at substantially right angles to the motion of the bridge on the gantry. The movement of the trolley and the movement of the bridge are substantially horizontal. A main hook is suspended from the trolley and is movable substantially vertically on the trolley. An auxiliary hook is also suspended from the trolley and is also movable substantially vertically on the trolley. There is a container suspended from the main hook and the auxiliary multi-function tool is suspended from the auxiliary hook. The auxiliary multi-function tool includes a primary tool and a secondary tool.

BRIEF DESCRIPTION OF THE DRAWINGS

The invention will be described in conjunction with the attached drawings, in which like reference numerals have been used for like parts and in which.

Figure 5:
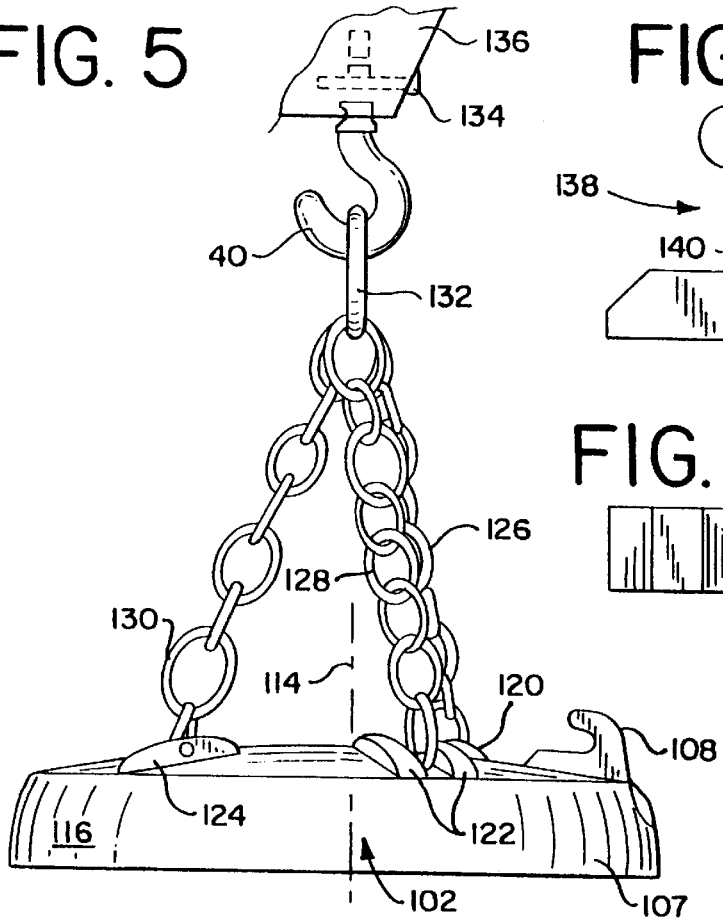
FIG. 5 is an elevation of an improved electromagnet of the system of the present invention.
Figure 6:
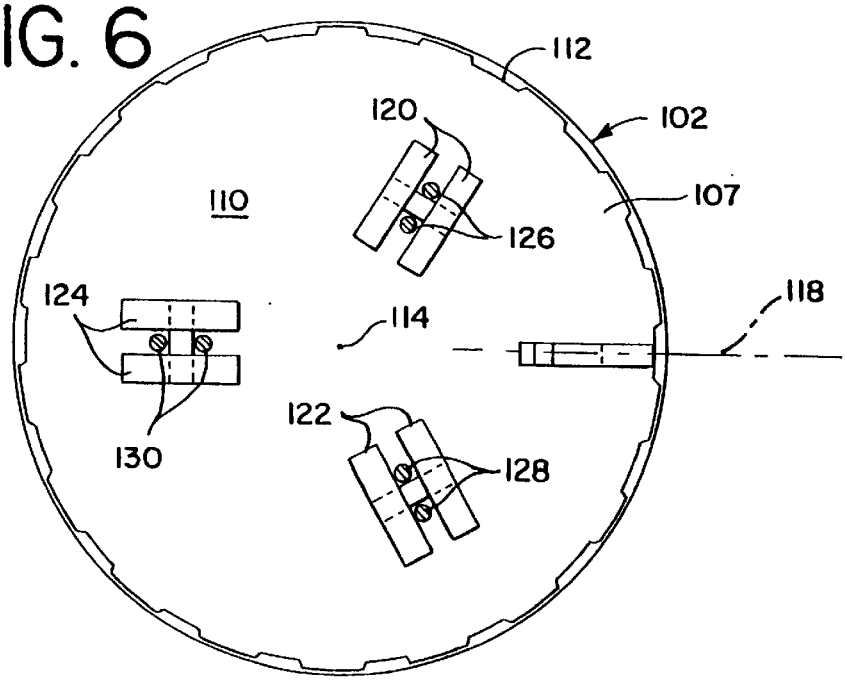
FIG. 6 is a top plan view of the improved electromagnet of FIG. 5.
Figure 9:
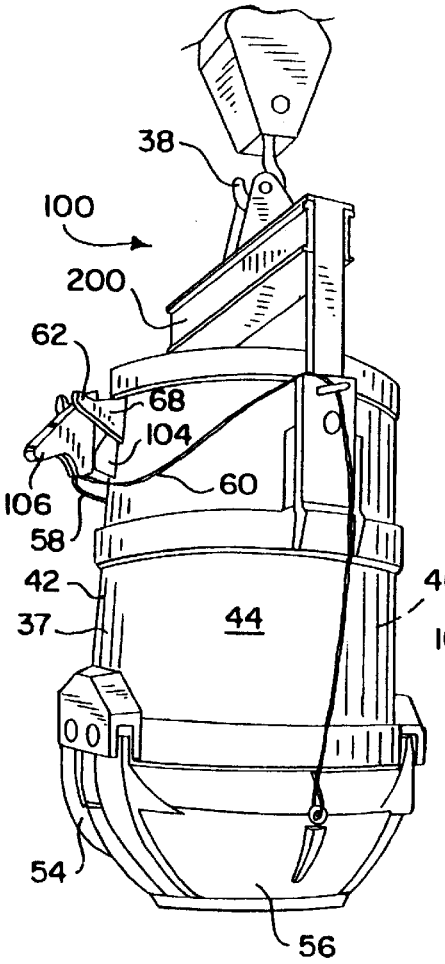
FIG. 9 is a perspective view of the improved scrap charge bucket of the present invention, with a hold out stand affixed to the scrap charge bucket and an improved target member supported on the saddle.
Figure 11:
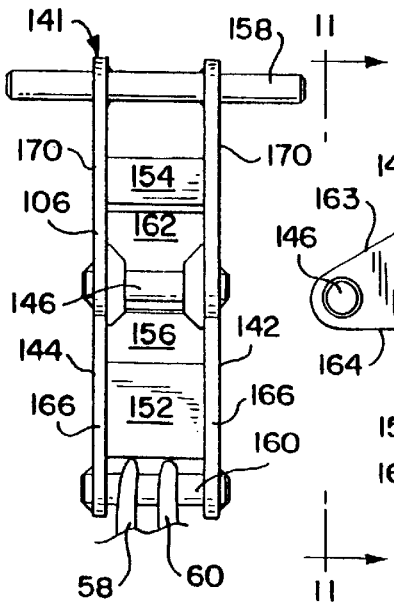
Figure 12:
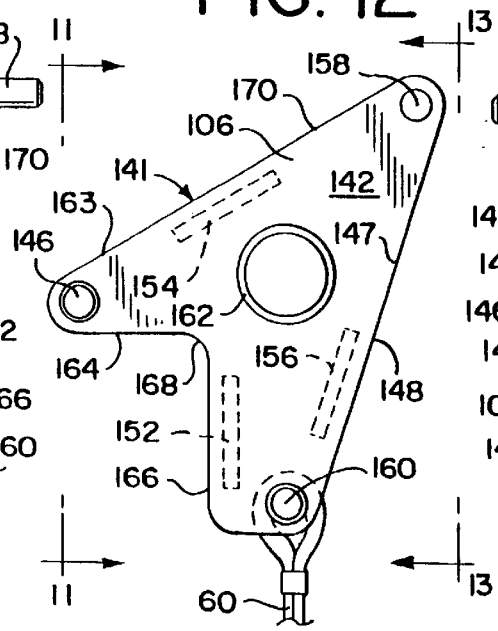
Figure 13:
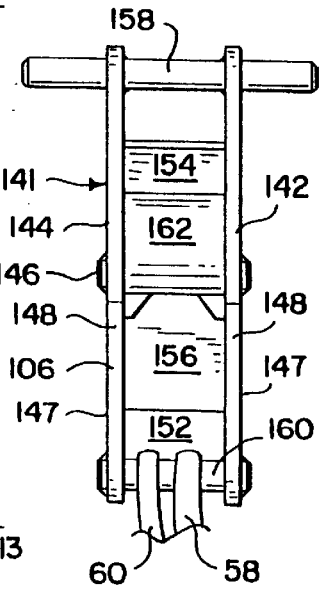
Figure 14:
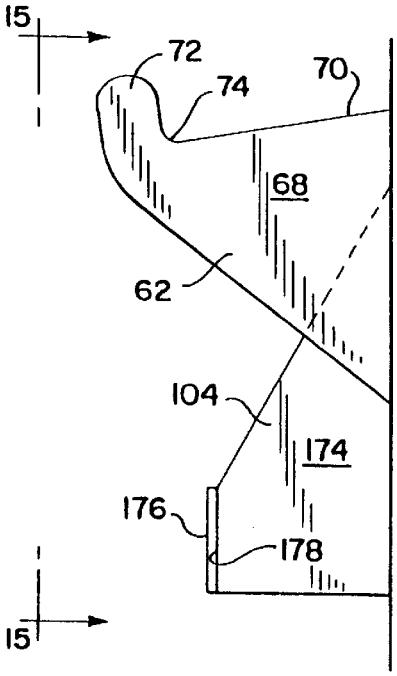
Figure 15:
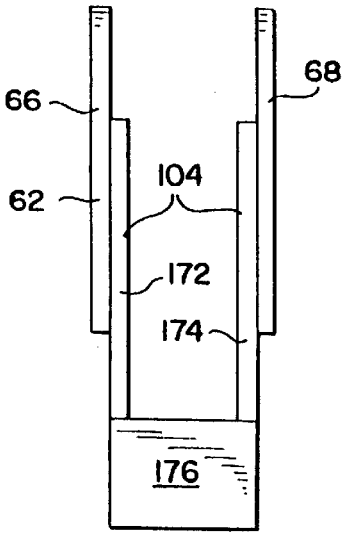
Figure 16:
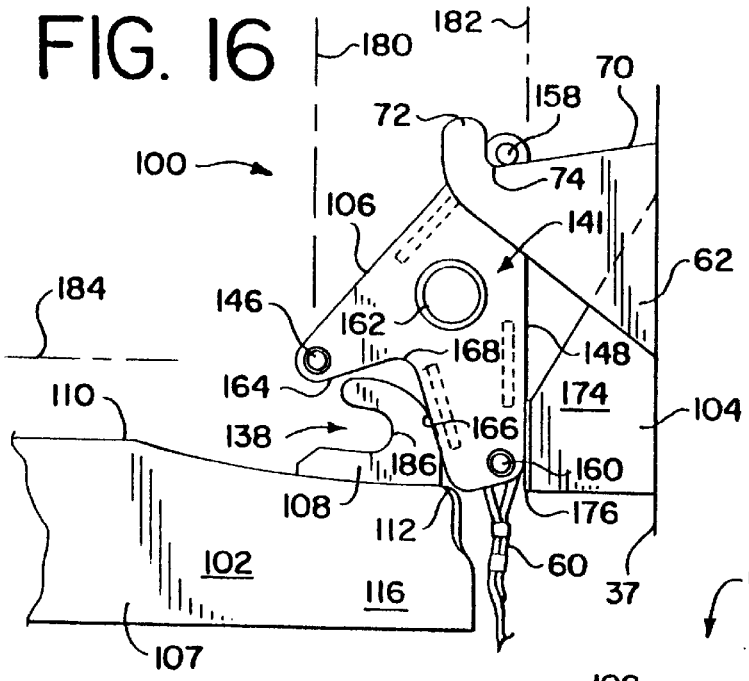
Figure 17:
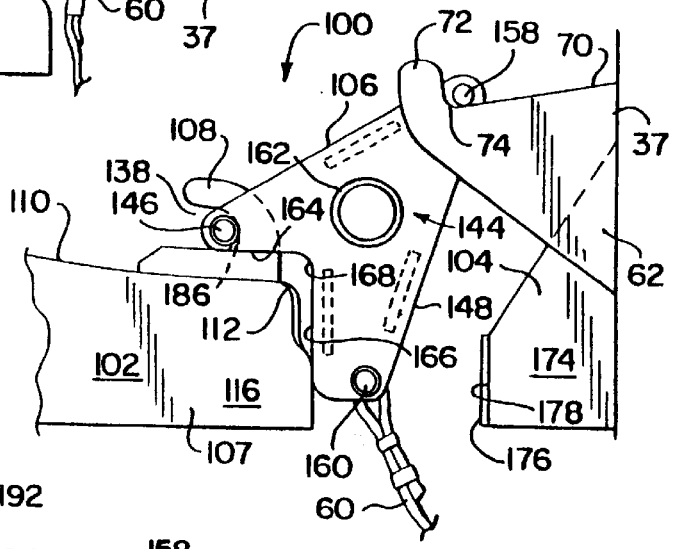
Figure 18:
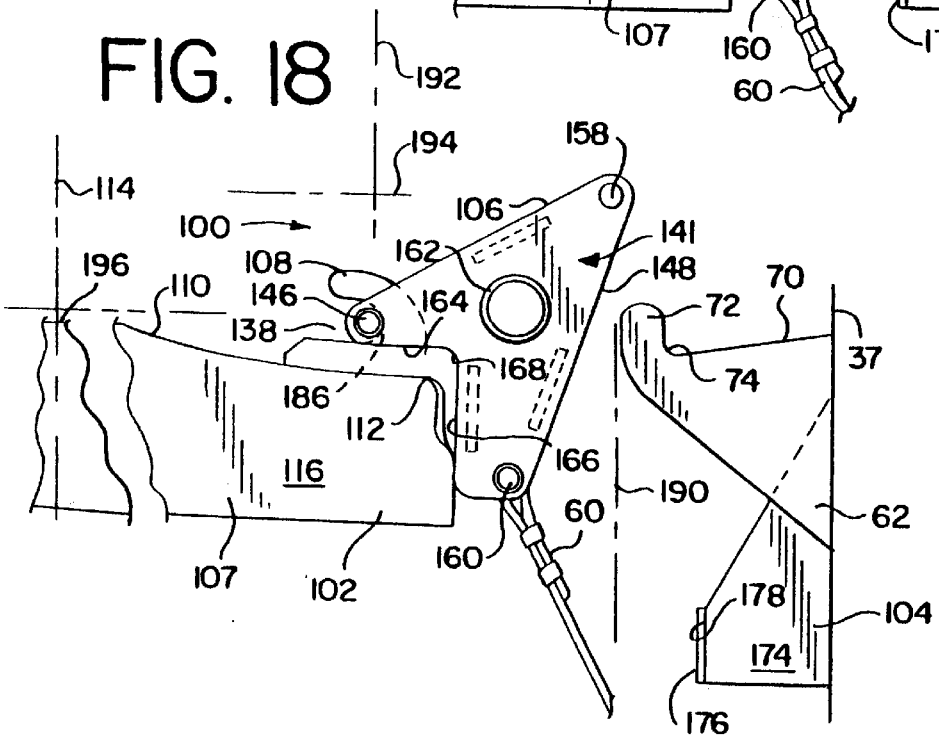

FIG., 10 is a perspective view of the improved scrap charge bucket of FIG. 9, shown with the electromagnet of FIGS. 5–6 supporting the target and being used to pull the actuators to open the bottom clam shell members to unload the scrap charge bucket contents into an electric arc furnace below the scrap charge bucket;

FIG. 11 is an end view of the improved target of the present invention, taken along line 11—11 of FIG. 12;

FIG. 12 is a side elevation of the improved target of the present invention;

FIG. 13 is an end view of the improved target of the present invention, taken along line 13—13 of FIG. 12;

FIG. 14 is a side elevation of the saddle and hold out stand of the present invention on the exterior surface of the scrap charge bucket;

FIG. 15 is an end view of the saddle and hold out stand, taken along line 15—15 of FIG. 14;

FIG. 16 is an elevation of the saddle, hold out stand and target of the present invention, with the target supported on the saddle and the electromagnet being moved into position to catch the target;

FIG. 17 is an elevation similar to that shown in FIG. 16, showing the electromagnet moved to a position wherein the catch member of the target is held within the auxiliary tool hook and wherein the electromagnet is raised to begin lifting the target off of the saddle;

FIG. 18 is an elevation similar to that shown in FIGS. 16–17, showing the electromagnet moved to a position wherein the target is lifted off of the saddle and supported on the electromagnet for pulling the actuators to open the scrap charge bucket;

FIG. 19 is an elevation of the saddle, hold out stand and target of the present invention, with the target supported on the saddle and the auxiliary hook being moved into position to catch the target;

FIG. 20 is an elevation similar to that shown in FIG. 19, showing the auxiliary hook moved to a position wherein the catch member of the target is held within the auxiliary tool hook and wherein the auxiliary hook is raised to begin lifting the target off of the saddle;

FIG. 21 is an elevation similar to that shown in FIGS. 19–20, showing the auxiliary hook moved to a position wherein the target is lifted off of the saddle and supported on the auxiliary hook for pulling the actuators to open the scrap charge bucket;

DETAILED DESCRIPTION

The present invention provides a system for moving material from one location to another location. The material-moving system of the present invention may be used in a foundry for moving scrap metal from scrap metal storage facilities to electric arc furnaces, as well as for moving other materials in other settings. The material-moving system of the present invention may be used in settings having existing and known containers for the material to be moved, as well as existing crane systems. In the following description of the invention, for parts that are the same as those shown in the prior art system described above, the same reference numbers will be used. Reference should be made to the description of the prior art for the specific features and characteristics of these standard elements, although it should be understood that unless specifically excluded, the principles of the present invention may be applied to other known material-moving systems.

In the present invention, the container 37 for the material to be moved may be like that described above, and may comprise a scrap charge bucket, although it should be understood that the invention is not limited to scrap charge buckets. The principles of the present invention may be used with other containers such as shipping containers or drop bottom totes. The container 37 may have a saddle member 62 like that illustrated, with two spaced, parallel saddle plates 66, 68, although it should be understood that other structures may be as a support structure, and the present invention is not limited to saddles of the type illustrated. The saddle member 62 could comprise a single plate or multiple plates or some support structure or structures other than plates. It should also be understood that the saddle member may be on another part of the container 37, such as the bail 200.

Figure 1:
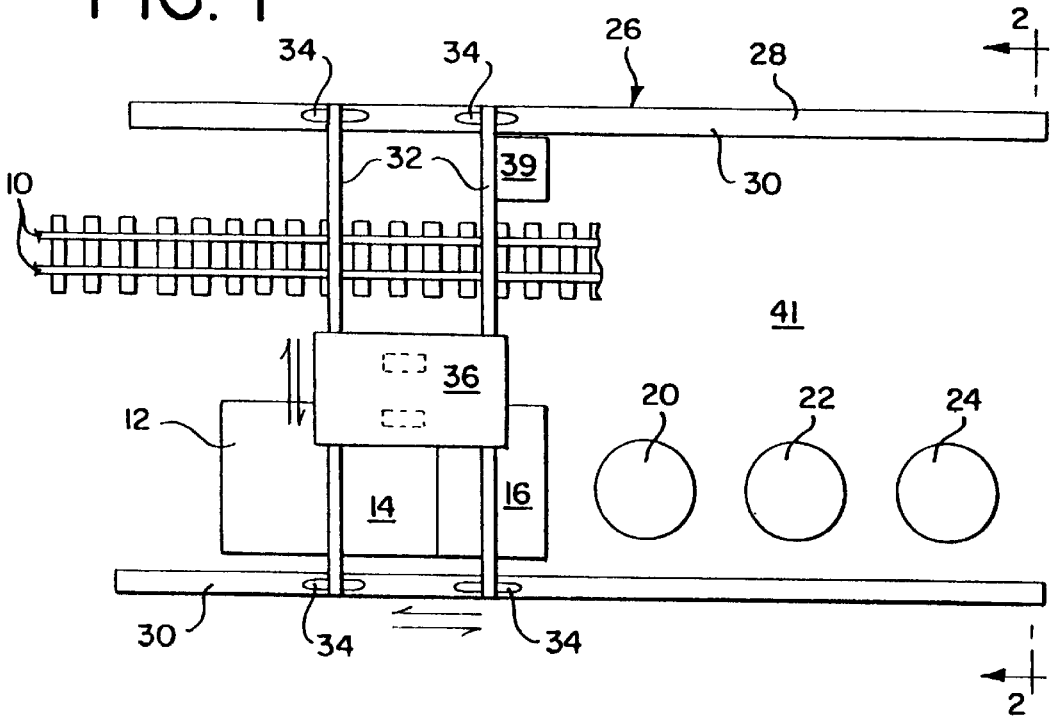
FIG. 1 is a schematic top plan view of a representative steel foundry.
Figure 2:
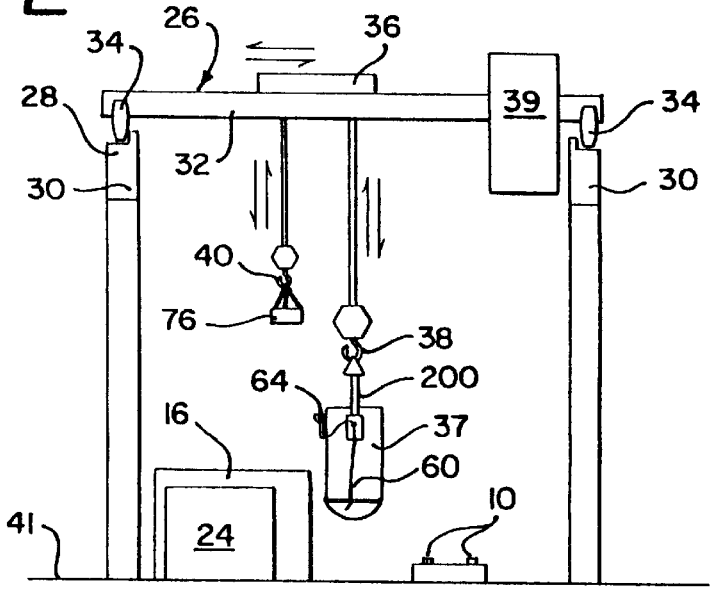
FIG. 2 is a schematic elevation of the representative steel foundry of FIG. 1, taken along line 2—2 of FIG. 1.
Figure 3:
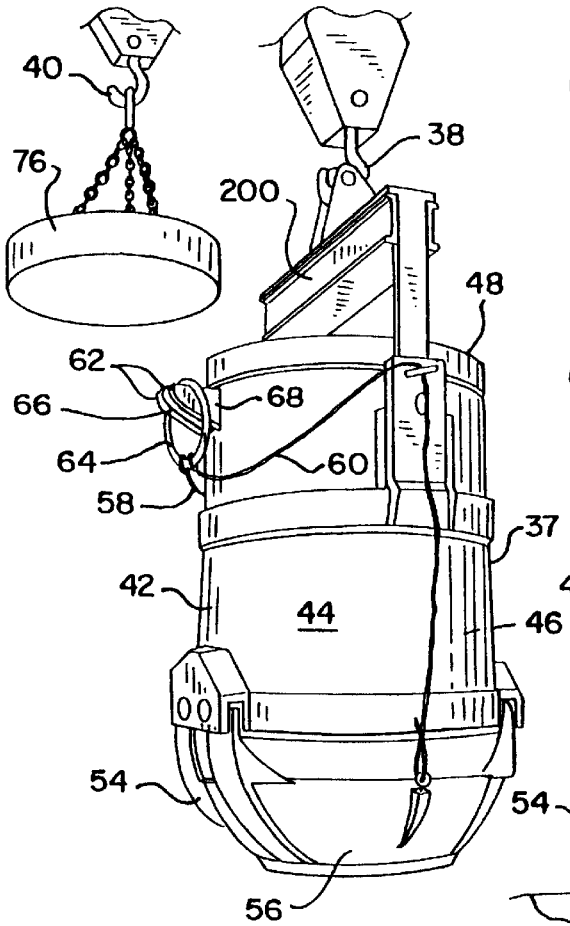
FIG. 3 PRIOR ART
FIG. 3 is a perspective view of a prior art scrap charge bucket and electromagnet carried on main and auxiliary hooks.
Figure 4:
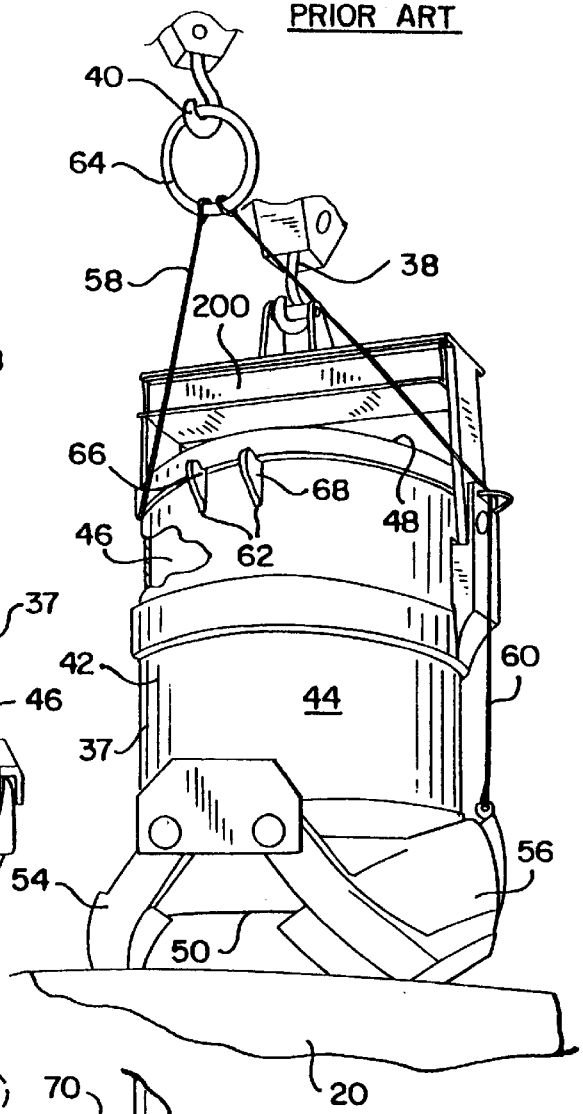
FIG. 4 PRIOR ART
FIG. 4 is a perspective view of a prior art scrap charge bucket overlying an electric arc furnace, with the clam shell bottom members of the scrap charge bucket opened to allow scrap metal to fall into the electric arc furnace.
Figure 4A:
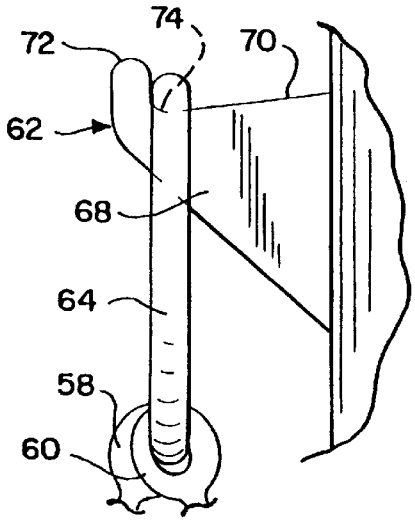
FIG. 4A PRIOR ART
FIG. 4A is an enlarged elevation of one saddle plate of a prior art saddle on the exterior of a scrap charge bucket.

The material-moving system of the present invention may include an overhead gantry 28, with rails 30, bridge 32, trolley 36 and operator cab 39 as illustrated in FIGS. 1–2 and described above in the Description of the Prior Art. The plant may also include standard furnaces, such as electric arc furnaces 20–24 and standard scrap storage facilities, such as scrap bins 12–16 as described above. The material-moving system may include a standard main hook 38 and a standard auxiliary hook 40, modified as described below. The material-moving system may include a container 37 such as a scrap charge bucket modified as described below. The material-moving system is generally designated 100 in FIGS. 9–10 and 16–21, although it should be understood that other elements such as the gantry 28 described above are also part of the material-moving system 100.

In the following description, the illustrated embodiment is in a foundry with electric arc furnaces 20–24, scrap bins 12–16, gantry 28, bridge 32, trolley 36 and hooks 38, 40 as described. However, it should be understood that the present invention is not limited to these elements or to this setting unless expressly set forth in the claims.

As in standard facilities, the overhead gantry 28 is sized and positioned so that the scrap charge bucket 37 is movable into a plurality of positions, including positions wherein the scrap charge bucket 37 on the main hook 38 lies outside and near at least a part of the scrap metal bins 12–16 and wherein the scrap charge bucket 37 on the main hook 38 overlies at least a part of the electric arc furnaces 20–24. The gantry also is sized and shaped to allow the magnet 107 to be moved to positions, including positions wherein the magnet 107 and auxiliary hook 40 overlie at least a part of the scrap metal bins 12–16 and at least a part of the electric arc furnaces 20–24. Generally, the overhead gantry 28 allows the scrap charge bucket 37 and magnet 108 to be moved back and forth between the electric arc furnaces 20–24 and the scrap metal bins 12–16, as illustrated in FIGS. 1–2. The gantry 28 may also be sized and shaped to allow a ladle to be moved as desired.

The material-moving system 100 of the present invention provides distinct improvements to the prior art systems, improvements that are preferably used in combination, but which can be used individually. The improvements of the present invention relate to an improved multi-function auxiliary tool 102, an additional hold out stand structure 104 to be added to the exterior of the scrap charge bucket 37, and a new target structure 106 that can replace the target ring 64 of the prior art.

As illustrated in FIGS. 5–6 and FIGS. 16–18, the improved multi-function auxiliary tool 102 includes a primary tool 107 and a secondary tool 108. The primary tool 107 in the illustrated embodiment is an electromagnet and the secondary tool 108 is a tool hook or magnet hook.

Except for the additional secondary tool 108, the electromagnet may be a conventional magnet, with a top surface 110 having a perimeter 112. The magnet may also include a central longitudinal axis 114 and a substantially vertical side surface 116 around the central longitudinal axis 114. The basic electromagnet may be a commercially available one, such as one available from Walker National, Inc. of Columbus, Ohio, Catalog No. DD-4160-14. It should be understood that this electromagnet is identified for purposes of illustration only and that the present invention is not limited to any particular magnet or to magnets generally unless expressly called for in the claims.

The secondary tool or magnet hook 108 is fixed to the top surface 110 of the primary tool or magnet 107 by welding in the illustrated embodiment, although other methods may be used. The illustrated magnet or tool hook 108 is fixed to open toward the central longitudinal axis 114 of the magnet 102. The illustrated tool or magnet hook 108 is aligned with at least a portion of the side surface of the magnet along a vertical radial plane, shown at 118 in FIG. 6. The maximum radial distance from the central longitudinal axis 114 of the primary tool or magnet 107 to the secondary tool or magnet hook 108 along this vertical radial plane 118 is less than the maximum radial distance from the central longitudinal axis 114 of the magnet to the side surface 116 of the magnet 102 along this vertical radial plane 118. Thus, the magnet hook 108 is sized and positioned to minimize the risk of the magnet hook 108 striking the interior of the railcar, truck, scrap bin or furnace when the magnet is used in a conventional manner as described above. In the illustrated embodiment, the magnet hook 108 does not extend beyond the perimeter 112 of the top surface 110 of the magnet 107.

In the illustrated embodiment, the magnet hook 108 is positioned about midway between two of the three equidistant pairs of chain attachment lugs 120, 122, 124 on the top surface 110 of the magnet 107. Each pair of chain attachment lugs is connected to an end link of a chain, and three chains 126, 128, 130 are connected to a master link 132, as in prior art material-moving systems. The auxiliary hook 40 extends through the master link 132, as in prior art material-moving systems. Preferably, the auxiliary hook 40 is fixed in a single orientation to prevent swiveling or rotation of the auxiliary hook 40 and magnet 102, to thereby preset the position of the magnet hook 108 and insure that the magnet hook 108 is always oriented properly for use. To so fix the auxiliary hook 40, a pin 134 may be inserted through aligned orifices in the auxiliary hook block 136 and auxiliary hook 40, as shown in FIG. 5.

Figure 7:
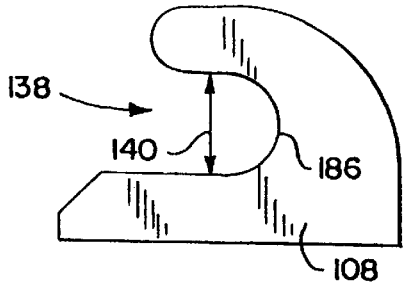
FIG. 7 is an elevation of the auxiliary tool hook of the electromagnet of FIGS. 5–6.
Figure 8:
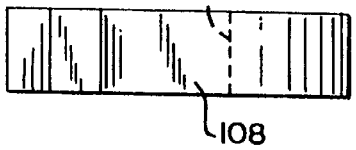
FIG. 8 is a top plan view of the auxiliary tool hook of FIG. 7.

The tool or magnet hook 108 that is welded to the basic magnet may be a standard hook, or a specially designed one. A suitable tool or magnet hook 108 is illustrated in FIGS. 7–8. In the illustrated embodiment, this magnet hook 108 is welded directly to the top 110 of the magnet 107, but it should be understood that the magnet or tool hook 108 could be fixed to a spacer plate or other structure that is permanently or removably attached to the top surface of the magnet 107 or other primary tool. The illustrated tool or magnet hook 108 is made of ASTM A5 14 Gr. F steel. It is about 2½ nominal inches thick, and has an overall length of about 10 nominal inches. Its overall height is about 7 nominal inches, with a hook opening 138 having a diameter shown at 140 in FIG. 7 of about 3 nominal inches. It should be understood that these dimensions and material are identified for purposes of illustration only, and that the present invention is not limited to any particular dimension unless expressly set forth in the claims.

The secondary tool or tool hook 108 feature of the present invention may be used with primary tools 107 other than an electromagnet, depending upon the application. Generally, a secondary tool 108 can be fixed to any primary tool 107 that is carried by the auxiliary hook 40 to allow for dual use of the auxiliary tool 102. Moreover, secondary tools 108 other than a hook could also or alternatively be added to the primary tool 107 to add to the functions of the auxiliary tool 102. By making the auxiliary tool 102 multi-functional, the present invention saves the time previously spent in changing over the tools carried by the auxiliary hook and saves the expense of providing a separate vertically-movable hook for each tool that is needed during production.

The improved multi-function auxiliary tool 102 of the present invention may be used with the prior art target ring 64, as well as with the improved target member 106 illustrated in FIGS. 11–13 and 19–21. However, the improved target member 106 of FIGS. 11–13 and 19–21 is preferred. The improved target member 106 is supported on the saddle member 62 on the container main body 42, as is the prior art target ring 64. And like the prior art, the improved target member 106 is connected to both actuator cables 58, 60 so that the bottom opening 50 to the container 37 can be uncovered by pulling on the target member 106.

The improved target member 106 of the illustrated embodiment comprises a cable bracket 141. As shown in FIGS. 11–13, the cable bracket 141 includes two spaced side plates 142, 144, a middle pin that serves as a catch member 146, a hold out surface 148, a plurality of spacer plates 152, 154, 156, an elongate saddle shaft or pin 158 and a cable shaft or pin 160.

In the illustrated embodiment, each side plate 142, 144 of the cable bracket 141 is a ¾ inch thick plate of ASTM A 36 steel. In the illustrated embodiment, the side plates 142, 144 are substantially identical to each other. The identical plates 142, 144 are connected together by the three rectangular spacer plates 152, 154, 156 of ¾ inch thick plate ASTM A 36 steel, each having dimensions of about 5 nominal inches by 6 nominal inches. The illustrated plates 152, 154, 156 are also connected by a central tube 162 and a group of shafts or pins 146, 158, 160. The central tube 162 has a nominal 5 inch outer diameter and a nominal 4 inch inner diameter, and a length of 5½ nominal inches. The two ends of the central tube 162 are received in aligned center holes in the two plates 142, 144, and welded to the edges of the plates 142, 144 at the center holes. The center tube 162 is made of standard steel tubing material. It should be understood that the above-identified dimensions may have standard manufacturing tolerances. It should also be understood that the shape and dimensions for these elements are given for purposes of illustration only, and that the present invention is not limited to use of these elements or to these elements having the described features unless expressly set forth in the claims.

Each of the illustrated plates 142, 144 also has three holes spaced from the center hole, the three holes aligned to define the three apexes of a triangle. The three holes include an upper hole, bottom hole and a middle hole. The corresponding upper, bottom and middle holes of the two plates are horizontally aligned. The aligned top holes of the two plates receive an elongate top shaft or pin 158, the aligned bottom holes of the two plates receive a bottom shaft or pin 160, and the aligned middle holes of the two plates receive the middle shaft or pin 146.

It should be understood that the shape of the plates 142, 144, and the use of these plates are provided by way of example only. The present invention is not limited to the use of these plates or to any particular shape, material or dimension unless expressly set forth in the claims.

The elongate top shaft or pin 158 in the illustrated embodiment is a nominal 1½ inch outer diameter steel alloy rounds 8620, with an overall nominal length of 15¼ inches. As shown in FIGS. 11 and 13, the elongate top shaft or pin 158 extends through both top holes, between the two plates 142, 144, and out beyond both plates 142, 144 a distance of about 4⅛ inches on both sides. These two top pin extensions are provided to rest on the top surfaces 70 of the saddle plates 66, 68 on the scrap charge bucket 37. The top shaft or pin 158 may be secured to the two plates 142, 144 through welding. It should be understood that the above-identified dimensions include standard manufacturing tolerances.

The middle and bottom shafts or pins 146, 160 in the illustrated embodiment are both nominal 1½ inch outer diameter steel alloy rounds 8620 pins with nominal lengths of 7½ inches. The middle shaft or pin 146 is inserted through the aligned middle holes of the two plates 142, 144 and the bottom shaft or pin 160 is inserted through the aligned bottom holes of the two plates 142, 144. The ends of the pins 146, 160 protrude slightly beyond the outer surfaces of the two plates 142, 144, and the protruding ends of the pins 146, 160 are welded to the two plates 142, 144.

It should be understood that all of the dimensions for the top, middle and bottom pins 158, 146, 160 may include standard manufacturing tolerances. It should also be understood that the use of these pins 158, 146, 160, their positions, their materials and their dimensions are provided as examples only, and that the present invention is not limited to the use of such pins, or to any particular position, material or dimension for pins unless expressly set forth in the claims.

As shown in FIGS. 12–13, the two plates 142, 144 of the illustrated cable bracket each have an inner edge 147 along a line parallel to a line between the centers of the top and bottom pins 158, 160. These inner edges 147 of the two plates 142, 144 are co-planar and define hold out surfaces 148 of the cable bracket 141. These hold out surfaces 148 function with the hold out stand 104 on the scrap charge bucket 37 to properly orient the cable bracket 37 on the saddle 62.

As shown in FIG. 12, in the illustrated cable bracket 141, between the bottom and middle pins 160, 146, each plate 142, 144 has an outer edge 163 that includes intersecting upper and lower portions 164, 166 joined by a curved portion 168. Each plate's outer edge also has a top angled portion 170. In the illustrated embodiment, the upper and lower portions 164, 166 are at right angles to each other and are joined by the curved portion 168. The upper portion 164 of one plate's outer edge is co-planar with the upper portion of the other plate's outer edge, and the lower portion 166 of the first plate's outer edge is co-planar with the lower portion of the second plate's outer edge. The function of the upper and lower outer edge portions 164, 166 is described below.

The illustrated embodiment of the material-moving system 100 of the present invention also includes an additional structure added to the exterior of the scrap charge bucket. This additional structure comprises a hold out stand 104 on the outer surface of the main body 42 of the scrap charge bucket 37. As shown in FIGS. 14–15, the hold out stand 104 of the illustrated embodiment comprises a pair of identical plates 172, 174 fixed to the side of the scrap charge bucket exterior surface 44, such as by welding, and a cross-plate 176 joining the two other plates. The two identical plates 172, 174 are positioned between the saddle plates 66, 68. The two hold out stand plates 172, 174 connected to the scrap charge bucket have co-planar edges 178 that are parallel to and spaced from the exterior surface 44 of the scrap charge bucket 37. The cross-plate 176 extends across these co-planar edges 178 below the saddle plates 66, 68, and is connected to the identical plates 172, 174 in a conventional manner, such as by welding.

As shown in FIGS. 16 and 19, when the cable bracket 141 is supported on the saddle 62 on the scrap charge bucket 37, the elongate top pin 158 of the cable bracket is supported on the saddle 62, with one end of the top pin 158 in the nook 74 of each saddle plate 66, 68. The top pin 158 thus comprises a saddle support member, resting on the top surfaces 70 of the two saddle plates 66, 68. It should be understood that the present invention is not limited to the use of an elongate pin as the saddle support member of the target member; other structures such as a ring could be used as a saddle support member or as both the saddle support and catch member of the target member.

On the saddle 62, the cable bracket 141 may pivot about the top pin 158. When the cable bracket 141 is on the saddle 62, the middle pin 146 comprises the catch member for the auxiliary tool hook 108: when the magnet or tool hook 108 engages or captures and lifts the middle pin or catch member 146, the cable bracket 141 can be lifted off of the saddle 62. It should be understood that the present invention is not limited to the use of such a pin as the catch member; other structures such as a ring or portion of a ring could be used as a catch member.

The two actuator cables 58, 60 of the scrap charge bucket 37 can be secured to any of the pins 146, 158, 160 or to the central tube 162. In the illustrated embodiment, the two actuator cables 58, 60 are shown with loop ends through which the bottom pin 160 of the cable bracket 141 extends. It should be understood that the actuator cables 58, 60 could be attached elsewhere on the cable bracket 141 if desired.

To simplify the process of engaging or capturing the catch member 146 of the cable bracket 141, it is desirable that the cable bracket 141 be oriented and stabilized so that the catch member 146 can be readily seen by the crane operator and so that it is relatively easy for the crane operator to maneuver the auxiliary tool 102 and auxiliary tool hook 108 to capture the catch member 146. In the illustrated embodiment of the present invention, the catch member 146 is oriented and stabilized by the combination of the size and shape of the cable bracket 141 and the size, shape and position of the hold out stand 104. As shown in FIGS. 16 and 19, gravity and the center of gravity of the cable bracket 141 cause at least part of at least one of the hold out surfaces 148 of the cable bracket 141 to bear against at least a part of the hold out stand 104. In the illustrated embodiment, the straight elongate surfaces of the two cable bracket plates' inner edges 147 along the span between the top and bottom pins 158, 160 bear against the cross plate 176 of the hold out stand 104. So oriented, the hold out surfaces 148 of the cable bracket 141 are substantially vertical.

Thus, when the cable bracket 141 is supported on the saddle 62 and the magnet hook 108 is spaced away from the cable bracket 141 and catch member 146, at least part of the catch member 146 is positioned in a vertical plane 180 that is spaced from the exterior surface 44 of the scrap charge bucket 37. The hold out surfaces 148 of the cable bracket 141 lie in a separate vertical plane 182 that is between the exterior surface 44 of the main body 42 of the scrap charge bucket 37 and the vertical plane 180 of the catch member 146. So oriented, at least a part of the catch member 146 also lies in a horizontal plane 184 spaced below the support surface 70 of the saddle 62. In addition, so oriented, the horizontal distance between the vertical plane 180 of the catch member and the exterior surface 44 of the container 37 is greater than the horizontal distance between the exterior surface 44 of the container 37 and the retention members 72 at the open end of the saddle 62. Thus, the catch member 146 is positioned where it can be seen by the crane operator and easily captured by the magnet hook 108. There is also sufficient clearance between the magnet hook 108 and the catch member 146 to allow the magnet 107 to be raised from beneath the catch member 146 until the top part of the magnet hook 108 is above the catch member 146.

As shown in FIGS. 17–18, when the magnet hook 108 engages the catch member 146, the shapes of the outer edges 163 of the cable bracket plates 142, 144 ensure that there is no interference between the cable bracket 141 and the magnet 107, and also secure the magnet hook 108 and catch member 146 together. As seen in FIG. 16, when the operator raises the auxiliary hook 40 to move the magnet hook 108 up from beneath the cable bracket 141, the magnet hook 108 is between and below the bottom pin 160 and catch member 146. As the operator continues to raise the auxiliary hook 40 and magnet 107, the lower portions 166 of the outer edges 163 of the cable bracket plates 142, 144 bear against the perimeter 112 of the top surface 110 of the magnet 107 and the side surface 116 of the magnet 107, and the cable bracket 141 pivots about the top saddle support pin 158 on the saddle 62. As the cable bracket 141 pivots about the top saddle support pin 158, the catch member 146 moves from the opening 138 of the magnet hook 108 into the closed end 186 of the magnet hook 108. As the cable bracket 141 pivots, the orientation of the hold out surfaces 148 of the cable bracket 141 also changes. As the operator continues to raise the auxiliary hook 40 and magnet 107, the cable bracket 141 continues to pivot about the top saddle support pin 158 until the lower portions 164 of the cable bracket plates' outer edges 163 bear against the side surface 116 of the magnet 107, as shown in FIG. 17. The magnet 107 may then be raised to raise the cable bracket 141 off of the saddle 62, as shown in FIG. 18.

With the cable bracket 141 positioned as shown in FIG. 18, the weight of the cable bracket 141 keeps the bracket 141 in place on the magnet 107. The cable bracket 141 position is stabilized and maintained on the magnet 107 by the weight of the cable bracket and the two cable bracket plates 142, 144 bearing against the magnet 107. Because of the shape of the cable bracket 141 and the complementary shape of the magnet 107 and shape and position of the magnet hook 108, when the cable bracket 141 is in the position shown in FIG. 18, the cable bracket 141 can only be removed from the magnet 107 through some relative rotation, which is unlikely in use due to the weight of the cable bracket 141.

When the cable bracket 141 is supported on the magnet 102, as shown in FIG. 18, the radial distance between the central longitudinal axis 114 of the magnet 102 to the vertical plane 190 of the top saddle support pin 158 is greater than the radial distance from the central axis 114 of the magnet 102 to the vertical plane 192 of the tool hook catch member 146, and the horizontal plane 194 of the top saddle support pin 158 is above the horizontal plane 196 of the tool hook catch member 146.

Figure 10:
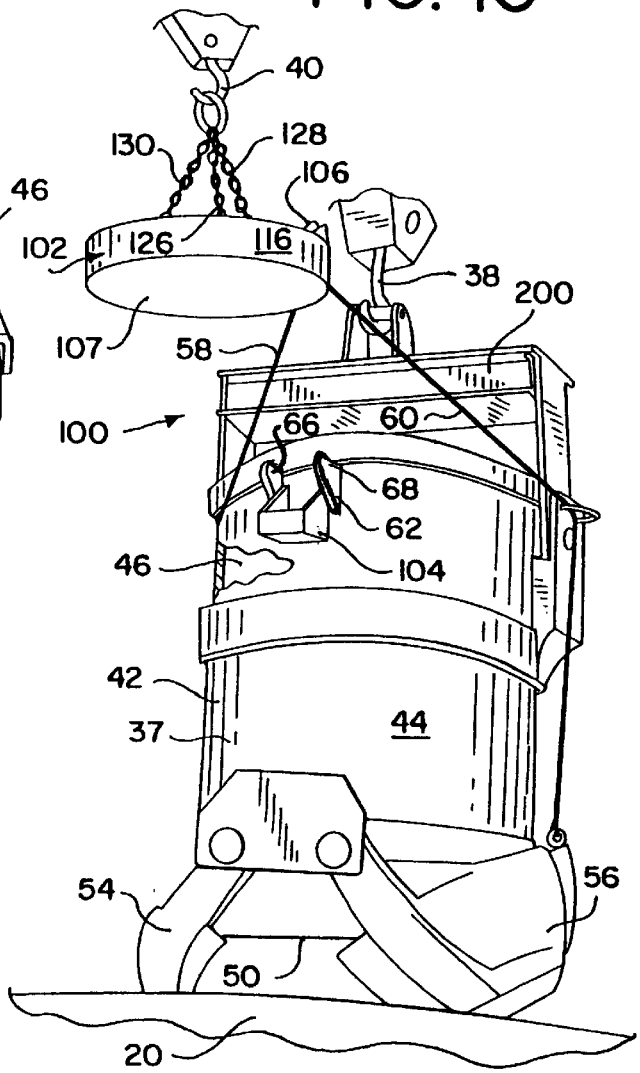

With the cable bracket 141 supported on the magnet 102, the magnet 107 can then be raised to thereby raise the cable bracket 141. As the cable bracket 141 is raised, the cable bracket 141 pulls the actuator cables 58, 60. The actuator cables 58, 60 pull the two pivotable clam shell structures 54, 56, which pivot to open the bottom of the scrap charge bucket 37 as shown in FIG. 10 so that the contents of the main body 42 may be discharged. Thus, the auxiliary tool 102 is movable so that the auxiliary tool hook 108 may capture the catch member 146 of the target member 106 so that the target member 106 may be pulled by moving the auxiliary tool 102 and the captured target member 146, and the opening 50 of the container 37 can be uncovered by pulling on the target member 106.

In use, the auxiliary hook 40 and magnet 107 may be operated as in the prior art, without interference from the magnet hook 108. When it is time to move scrap or other material from the train or truck to the scrap bin 12–16, the operator may move the bridge 32 on the gantry 28 to a position overlying the scrap rail car or truck, and may move the trolley 36 on the bridge 32 to a position wherein the auxiliary hook 40 and magnet 102 overlie the scrap to be moved. At this stage, the auxiliary hook 40 is connected to the auxiliary multi-function tool 102. The operator may then lower the auxiliary multi-function tool 102 into the scrap railcar or truck and activate the magnet 107 to pick up scrap metal. Since the magnet hook 108 is positioned inboard of the side surfaces 116 of the magnet 107, the magnet hook 108 should not strike the walls of the railcar or truck bed, minimizing potential damage to the magnet hook 108 or railcar or truck. The operator may move the scrap into the scrap bin, and may use the magnet 107 as it is normally used, placing it in the scrap bin 12–16 or other receptacle, with minimal risk of damage to receptacle from the magnet hook 108. The operator may also use the magnet 107 to adjust the scrap metal in the electric arc furnaces 20–24 with minimal risk of damage to the furnace walls or magnet hook 108 since the magnet hook 108 is positioned to minimize the potential for contact with the surfaces of the electric arc furnaces.

Since the opening 138 of the magnet hook 108 is directed toward the center of the magnet 102, there is also minimal potential for the magnet hook 108 to become entangled in the cables of the main hook 38. Accordingly, there is minimal potential for danger from the magnet hook 108 damaging the cables supporting the main hook 38. And since the auxiliary hook 40 is prevented from rotating, the opening of the auxiliary hook 40 may be directed away from the main hook cables to minimize the potential for entanglement of the auxiliary hook 40 and main hook cables. This safety feature is especially significant when the main hook 38 is used to carry a ladle of molten metal.

And as described above, the operator may use the magnet hook 108 to perform the tasks of the auxiliary hook 40 or other tool without removing the magnet 102 from the auxiliary hook 40. Thus, time is saved. And since the operator can operate the main hook 38 and multi-purpose auxiliary tool 102 to perform the tasks of the main hook 38, magnet 107, and auxiliary hook 40 with only two hooks, the system is simpler than those using three hooks to perform these same tasks.

As described above, the system of the present invention may be used with variations from the embodiment illustrated in the accompanying drawings. For example, it may be desirable to use a tool other than a hook on the magnet or other auxiliary device. It may also be desirable to include more than one secondary tool 108 on the primary tool 107, or to make the secondary tool 108 on the magnet removable and replaceable for different applications. It might also be desirable to use a ring or other structure with a catch as the secondary tool 108 on the magnet 107, and connect a hook to the actuator cables 58, 60, in which case the hook would comprise the target to be engaged by the secondary tool.

In addition, although the illustrated embodiment shows the saddle 62 and hold out stand 104 on the exterior surface 44 of the main body 42 of the container 37, these structures 62, 104 could be located elsewhere, such as on the bail 200 of the container 37.

It should also be understood that features of the present invention, such as the hold out stand 104 and target 106 may be used in a conventional manner, as illustrated in FIGS. 19–21. As there shown, the auxiliary hook 40 may be used without a magnet or other tool to catch and lift the target member 106 to pull the cables 58, 60 to open the container 37.

While only specific embodiments of the invention have been described and shown, it is apparent that various alternatives and modifications can be made thereto, and that parts of the invention may be used without using the entire invention. Those skilled in the art will recognize that certain modifications can be made in these illustrative embodiments. It is the intention in the appended claims to cover all such modifications and alternatives as may fall within the true scope of the invention.

We claim:

1. A system for moving material from one location to another location, the system comprising:

a container for material to be moved, the container having a main body with an exterior surface, an open interior and at least one opening leading into the open interior of the main body, the container also including at least one movable structure for covering and uncovering the opening into the open interior of the main body, and at least one actuator for moving the movable structure;

a vertically movable main hook;

a vertically movable auxiliary hook;

the main hook and auxiliary hook being movable in a plurality of horizontal directions;

the container being suspended from the main hook;

an auxiliary multi-function tool suspended from the auxiliary hook, the auxiliary multi-function tool including a primary tool and a secondary tool; and a target member connected to the actuator so that the opening to the container can be uncovered by moving the target member, the auxiliary tool being movable so that at least part of the secondary tool may engage at least a part of the target member so that the target member may be moved by moving the auxiliary multi-function tool and engaged target member.

2. The system of claim 1 wherein the container includes a saddle member extending outwardly from the exterior surface of the main body of the container and wherein the target member is supported on the saddle.

3. The system of claim 1 wherein the container comprises a scrap charge bucket with two movable structures for covering and uncovering one of the openings into the open interior of the main body, the movable structures being pivotally connected to the main body and being openable in a clam shell manner, the container including two actuators, one actuator connected to one movable structure and both actuators being connected to the target member.

4. The system of claim 1 wherein the primary tool of the multi-function auxiliary tool comprises a magnet.

5. The system of claim 1 wherein the secondary tool comprises a tool hook and wherein the target member is selected from the group consisting of a ring and a cable bracket and wherein the actuator comprises a cable.

6. The system of claim 1 wherein the secondary tool comprises a tool hook and wherein the target member comprises a cable bracket and the actuator comprises a cable, the cable bracket comprising a plate and a catch member.

7. The system of claim 6 further comprising a hold out stand on the container.

8. The system of claim 7 wherein:

the container includes a saddle member extending outwardly from the exterior surface of the container main body, and wherein the cable bracket is supported on the saddle member;

the cable bracket includes a catch member and a hold out surface, at least part of the hold out stand bearing against at least part of the hold out surface of the cable bracket when the secondary tool is spaced from the cable bracket and the cable bracket is supported on the saddle;

the catch member lying in a vertical plane spaced from the exterior surface of the container main body, the hold out surface lying in a separate vertical plane between the exterior surface of the container main body and the vertical plane of the catch member.

9. The system of claim 8 wherein the saddle includes a support surface and the catch member lies in a horizontal plane spaced below the support surface of the saddle.

10. The system of claim 8 wherein:

the primary tool has a top surface, a central longitudinal axis, and a side surface; and the cable bracket comprises a plate and a catch member, the catch member being captured by the secondary tool hook and at least a part of the cable bracket bearing against the side surface of the primary tool, the cable bracket further including a saddle support member, at least parts of the catch member and the saddle support member lying in spaced vertical and horizontal planes, the radial distance from the central longitudinal axis of the primary tool to the vertical plane of the saddle support member being greater than the radial distance from the central longitudinal axis of the primary tool to the vertical plane of the catch member, and the horizontal plane of the saddle support member being above the horizontal plane of the catch member.

11. The system of claim 1 wherein the primary tool comprises a magnet having a top surface, a central longitudinal axis, and a side surface, and wherein the secondary tool comprises a tool hook on the top surface of the primary tool, the tool hook opening toward the central longitudinal axis of the primary tool.

12. The system of claim 1 wherein the primary tool comprises a magnet having a top surface, a central longitudinal axis, and a side surface, wherein the secondary tool comprises a tool hook and wherein at least a part of the primary tool side surface is vertically aligned with the tool hook along a vertical radial plane, and wherein the maximum radial distance from the central longitudinal axis of the primary tool to the tool hook along the vertical radial plane is less than the maximum radial distance from the central longitudinal axis of the primary tool to the portion of the side surface aligned with the tool hook along the vertical radial plane.

13. The system of claim 1 further comprising:

an overhead gantry;

a bridge extending between portions of the gantry and movable along the gantry in opposite directions in a substantially horizontal plane;

a trolley movable along the bridge in opposite directions in a substantially horizontal plane, the movement of the trolley being at substantially right angles to the movement of the bridge on the gantry;

the main hook and the auxiliary hook being suspended from the trolley and being movable vertically toward and away from the trolley, vertical movement of the main hook being independent of vertical movement of the auxiliary hook, the main hook and auxiliary hook moving horizontally with horizontal movement of the trolley and bridge.

14. The system of claim 13 further including at least one electric arc furnace and at least one scrap metal bin spaced from the electric arc furnace, the gantry being positioned so that the auxiliary multi-function tool is movable between the electric arc furnace and the scrap metal bin.

15. A system for moving material from one location to another location, the system comprising:

a container for material to be moved, the container having a bail and a main body with an exterior surface, an open interior and at least one opening leading into the open interior of the main body, the container also including at least one movable structure for covering and uncovering the opening into the open interior of the main body, at least one actuator cable connected to move the movable structure, and a saddle member having an open end;

a vertically movable main hook;

a vertically movable auxiliary hook;

the main hook and auxiliary hook being movable in a plurality of horizontal directions;

the container being suspended from the main hook; and a cable bracket supported on the saddle member, the cable bracket being connected to the actuator cable, the cable bracket including a catch member so that the opening to the container can be uncovered by pulling on the catch member of the cable bracket, at least part of the catch member lying in a vertical plane spaced from the saddle member, the cable bracket further including a substantially vertical hold out surface spaced from the vertical plane of the catch member;

the system further including a hold out stand on the container, at least part of the hold out stand bearing against at least part of the hold out surface of the cable bracket;

the horizontal distance between the vertical plane of the catch member and the container being greater than the horizontal distance between the container and the open end of the saddle member;

wherein the cable bracket is removable from the saddle member, the orientation of the cable bracket hold out surface changing as the cable bracket is removed from the saddle member.

16. The system of claim 15 further comprising an auxiliary tool suspended from the auxiliary hook, the auxiliary tool including a tool hook and a substantially vertical side surface, and wherein the cable bracket is removable from the saddle by capturing the catch member in the tool hook, raising the auxiliary hook and auxiliary tool so that the cable bracket pivots about the catch member on the tool hook, thereby moving the cable bracket hold out surface away from the hold out stand, the cable bracket pivoting until one of its surfaces bears against the side surface of the tool.

17. A system for moving material from one location to another location, the system comprising:

an overhead gantry;

a bridge extending between portions of the gantry and movable along the gantry in opposite directions;

a trolley movable along the bridge in opposite directions, the motion of the trolley on the bridge being at substantially right angles to the motion of the bridge on the gantry, the motion of the trolley and the motion of the bridge being substantially horizontal;

a main hook suspended from the trolley and movable substantially vertically on the trolley;

an auxiliary hook suspended from the trolley and movable substantially vertically on the trolley;

a container suspended from the main hook; and an auxiliary multi-function tool suspended from the auxiliary hook, the auxiliary multi-function tool including a primary tool and a secondary tool.

18. The system of claim 17 wherein the primary tool of the auxiliary multi-function tool comprises a magnet suspended from the auxiliary hook, the magnet having a top surface, a central longitudinal axis, and a side surface, and the secondary tool of the auxiliary multi-function tool comprises a magnet hook on the top surface of the magnet, the magnet hook opening toward the central longitudinal axis of the magnet, a portion of the side surface of the magnet being vertically aligned with the magnet hook along a vertical radial plane, the maximum radial distance from the central longitudinal axis of the magnet to the magnet hook along the vertical radial plane being less than the maximum radial distance from the central longitudinal axis of the magnet to the portion of the side surface of the magnet vertically aligned with the magnet hook along the vertical radial plane;

wherein the container comprises a scrap charge bucket suspended from the main hook;

the system further comprising at least one scrap metal bin and at least one electric arc furnace;

wherein the gantry is dimensioned and positioned to allow the main and auxiliary hooks to be moved into pluralities of positions, including positions wherein the magnet on the auxiliary hook overlies at least a part of scrap metal bin and wherein the scrap charge bucket on the main hook overlies at least a part of the electric arc furnace;

and wherein the scrap charge bucket has a main body with an exterior surface and an open interior for holding scrap metal, a pair of pivotable clam shell structures, a pair of actuator cables, each actuator cable being connected to one clam shell structure, and a saddle member, the saddle member having at least one support area.

19. The system of claim 18 further including a cable bracket resting on the support area of the saddle member, the cable bracket being connected to both actuator cables, the cable bracket including a catch member fitting within the opening of the magnet hook.

20. The system of claim 19 wherein the cable bracket includes a surface resting against a portion of the side surface of the magnet.

21. The system of claim 18 wherein the saddle member is on the exterior surface of the main body of the container, the system further including:

a cable bracket resting on the support area of the saddle member, the cable bracket being connected to both actuator cables, the cable bracket including a catch member and a hold out surface, the catch member lying a horizontal plane and a vertical plane; and a hold out stand on the exterior surface of the scrap charge bucket main body, at least a part of the hold out stand bearing against the hold out surface of the cable bracket.

22. The system of claim 21 wherein the hold out surface of the cable bracket is between the vertical plane of the catch member and the exterior surface of the main body of the scrap charge bucket.

* * * * *